US006012660A

United States Patent [19]

Colman

[11] Patent Number: 6,012,660

[45] Date of Patent: Jan. 11, 2000

[54] ROTARY ICE SHAVING MACHINE

[75] Inventor: Mark Colman, Woodbury, Minn.

[73] Assignee: Vaansinn Products, Inc., Hudson, Wis.

[21] Appl. No.: 09/088,266

[22] Filed: Jun. 1, 1998

Related U.S. Application Data

[60] Provisional application No. 60/069,123, Dec. 2, 1997.

[51] Int. Cl.[7] ..... B02C 19/12

[52] U.S. Cl. ..... 241/30; 241/37.5; 241/100; 241/199.9; 241/285.3; 241/DIG. 17

[58] Field of Search ..... 241/37.5, 30, 100, 241/199.9, 280, 285.1, 285.2, DIG. 17, 27, 29

[56] References Cited

U.S. PATENT DOCUMENTS

| | | | |
|---|---|---|---|
| 753,161 | 2/1904 | Reinhold . | |
| 2,477,474 | 7/1949 | Bert | 241/92 |
| 3,552,663 | 1/1971 | Royals | 241/92 |
| 3,648,462 | 3/1972 | Lyman | 62/354 |
| 4,012,185 | 3/1977 | Poore et al. | 425/120 |
| 4,055,099 | 10/1977 | Mitsubayashi | 83/403 |
| 4,113,190 | 9/1978 | Fudman | 241/92 |
| 4,123,918 | 11/1978 | Kohl et al. | 62/230 |
| 4,168,805 | 9/1979 | Taylor | 241/101.2 |
| 4,569,266 | 2/1986 | Ando | 241/37.5 X |
| 4,575,012 | 3/1986 | Uphoff et al. | 241/92 |
| 4,588,136 | 5/1986 | Homma | 241/95 |
| 4,589,599 | 5/1986 | Williams | 241/37.5 |
| 4,655,403 | 4/1987 | Sciortino | 241/92 |
| 4,681,030 | 7/1987 | Herbert | 99/484 |
| 4,718,610 | 1/1988 | Gallaher | 241/37.5 |
| 4,745,773 | 5/1988 | Ando | 62/320 |
| 4,762,282 | 8/1988 | Wessa | 241/190 |
| 4,786,002 | 11/1988 | Mitsubayashi et al. | 241/101 B |
| 4,919,075 | 4/1990 | Himi | 118/699 |
| 4,927,087 | 5/1990 | Palochak | 241/100.5 |
| 4,930,685 | 6/1990 | Landers | 222/370 |
| 4,962,895 | 10/1990 | Gallaher | 241/101.2 |
| 4,998,677 | 3/1991 | Gallaher | 241/95 |
| 5,050,809 | 9/1991 | Rupp | 241/86.1 |
| 5,402,949 | 4/1995 | Berner et al. | 241/101.2 |
| 5,513,810 | 5/1996 | Lin | 241/95 |

OTHER PUBLICATIONS

SnoBiz Model SB–700 Ice Shaver Owner's Manual, Crystal Fresh, Inc., Mpls, MN., 1994, 11 pages.

Gold Medal 1997 Catalog, front cover, pp. 39–41, 43–45.

Hatsuyuki Model HC–8E and HF–500E Ice Shaver promotional flyer, updated, one page.

Sheng Yuan Machine Foundary Co., Ltd Internet printout, Sep. 30, 1997, 4 pages.

Miao Hsien Enterprise Co., Ltd Internet printout, Sep. 30, 1997, 4 pages.

(List continued on next page.)

*Primary Examiner*—John M. Husar

*Attorney, Agent, or Firm*—Briggs and Morgan

[57] ABSTRACT

A vertically-oriented rotary ice shaving machine in which the drive head assembly (including the ice-engaging mechanism, upper drive linkage, and housing) descend toward the table from the raised position at substantially the same rate. The drive head assembly is supported on telescoping columns, and a telescoping drive shaft connects the motor to the upper drive linkage. Alternately, the motor may be mounted on a carriage which moves reciprocally with the drive head assembly. The drive head assembly may exert downward pressure on the ice block via tension exerted by the telescoping drive shaft and support columns, or due to the weight of the drive head components and motor. Mechanical and electrical interlocks prevent the blade from being raised to an exposed position, and similarly interrupt rotation of the ice block, until the protective doors are closed. The protective doors are secured in the closed position while the blade is extended. The blade is cammed from the exposed to a retracted position to protect the operator from injury when inserting a block of ice or removing a remnant. The extended blade height may be manually adjusted, independently of the camming mechanism. The blade is spaced radially from the axis of rotation of the ice block to maintain a stability during the shaving process. The angled face forming the sharp edge of the blade is further oriented away from the lower surface of the ice block so as to chisel the ice surface more effectively.

41 Claims, 8 Drawing Sheets

OTHER PUBLICATIONS

FlavorSnow Manufacturing Co. Internet printout, Sep. 30, 1997, 3 pages.

Bud–Dee Distributing Internet Printout, Sep. 30, 1997, 2 pages.

Southern Snow Manufacturing, Inc. Southern Snow Machine promotional flyer, undated, 1 page.

Eisenmann Products/FlavorSnow letter and Snow Machine II promotional flyer, Oct. 1, 1997, 2 pages.

FIG. 8A
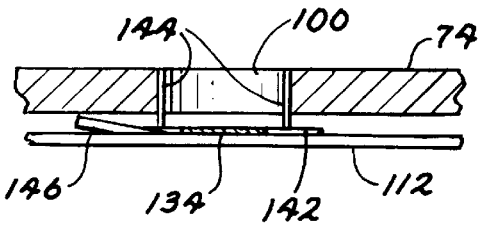
FIG. 8B
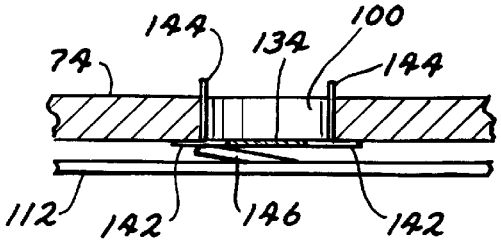
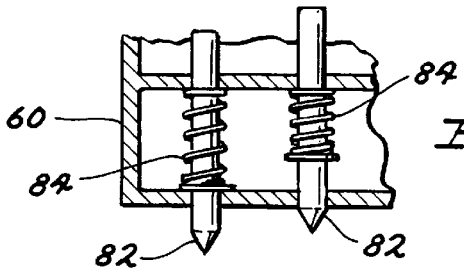
FIG. 11
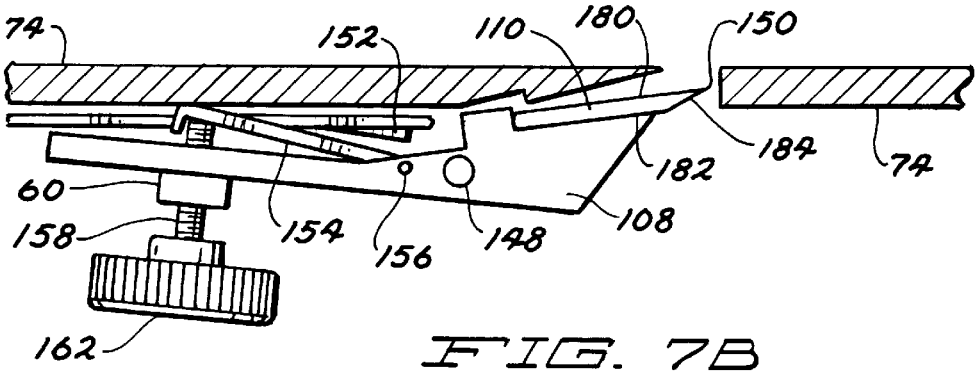
FIG. 7B
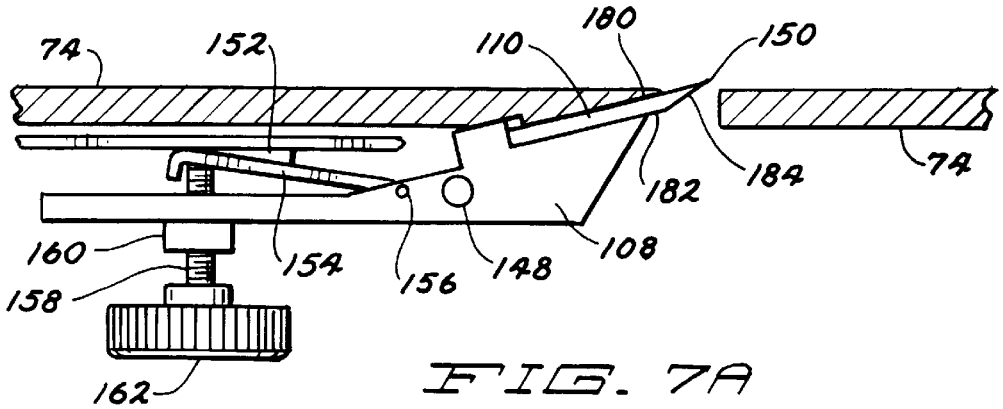
FIG. 7A

ROTARY ICE SHAVING MACHINE

RELATED APPLICATIONS

This application is a continuation-in-part and claims the benefit of priority pursuant to 35 USC § 120 from provisional U.S. patent application Ser. No. 60/069,123 filed on Dec. 2, 1997 of the same title.

BACKGROUND OF THE INVENTION

1. Field of the Invention

This invention relates generally to ice shaving machines, and particularly to improvements in a vertically-oriented rotary ice shaving machine in which the ice block is rotated against a stationary blade by a descending drive head assembly.

2. Description of the Prior Art

Initially, the field of ice shaving machines must be distinguished from other devices for creating crushed or pulverized ice granules from blocks, irregular chunks, or cubes of ice, such as those commonly designed to make flavored "slush" drinks sold under trade names such as "Slurpee" or "Sno-Kone." Many such machines are frequently but incorrectly referred to as ice shaving machines—or their manufacturers may represent that they produce shaved ice—however the operation of those machines and the resultant product obtained are substantially dissimilar in both character and quality to true shaved ice produced using an ice shaving machine.

Conventional ice shaving machines essentially shave or scrape a thin surface layer from the planar side of a block of ice. Either the ice block or the blade is rotated, depending on the design of the machine. The shaved ice is collected in a receptacle area, and may be used for a variety of purposes including confectionery desserts to which flavored syrups, fruit, or other ingredients are added, or in the preparation of a chilled bed for the presentation of sushi, sashimi, caviar, or similar foods.

To those practiced in the associated culinary arts, both the texture and flavor of shaved ice can be readily distinguished from crushed or pulverized ice, as well as other forms of granular or flaked ice products manufactured using cutting, grinding, chopping, rapid freezing, or sublimation processes. The distinct amenability of shaved ice to certain uses makes the ability to quickly, uniformly, and safely shave ice in a restaurant or other food-preparation setting a desirable and long sought-after goal.

Those skilled in the art generally categorize ice shaving machines depending upon their vertical or horizontal orientation, with each type of machine being designed for operation in particular situations or environments. Representative examples of a variety of commercially available ice shaving machines embodying both the vertical and horizontal orientation and considered exemplary of the current state of the art are disclosed in the references submitted with this specification, as identified in the file history hereof, and which are incorporated herein by reference.

One noteworthy example of conventional ice shaving machines is shown in U.S. Pat. No. 5,402,949 to Bemer, which discloses a vertically-oriented design having a base, an intermediate table on which the ice block is rotated, a blade extending through a slot in the table, and a vertically-moveable spindle carrying an ice-engaging mechanism on the lower end. The spindle is driven by a top-mounted motor to rotate the ice block, and is threaded to travel downward exerting pressure on the ice block toward the blade.

The Bemer '949 patent also discloses such features as: a protective shield and visually open back which permit viewing the ice-shaving process from a variety of perspectives; manually raising the spindle or adjusting its height using a crank mechanism located on the side of the upper housing; and raising or lowering the blade height relative to the top surface of the table by winding a threaded adjustment mechanism through a complete continuum from a raised to a lowered position and back to the raised position.

However, the vast majority of existing ice shaving machines suffer from a variety of drawbacks, some of which are similarly presented by the Berner '949 device.

Many of the machines orient the cutting edge of the blade in an "inverted-plane" orientation, so that the angled face of the blade is disposed toward the surface of the ice block being shaved. Such an orientation is shown in FIG. 4 of Bemer '949 patent, however the actual angle of the face of the blade forming the cutting edge is more closely parallel to the surface of the ice block than depicted in the diagram. As a result, the block of ice tends to ride on the angled face of the blade, and the sharp edge of the blade "scrapes" obliquely against the ice rather than actually "chiseling" into the lower surface of the ice block. The block of ice will bounce along the angled face of the blade if the surface is not uniform, and the results are poor quality and slow production.

Since the inner radial edge of the blade extends entirely inward to the axial center of the ice block, the shaving process adjacent the center of rotation is retarded. Essentially, the inner radial edge of the blade acts as a bearing supporting the block, forcing the ice near the center to melt or crack away in order to allow shaving along the rest of the blade's length. This leads to misalignment and therefore non-uniform contact between the blade and ice block. As a result, only the outer segment of the blade may contact the ice surface sufficiently to shave the block—thus escalating the misalignment problem—and the downwardly protruding ice near the center can cause the ice block to wobble relative to the blade. These deficiencies slow the shaving process significantly, and seriously denigrate the quality of the resultant product. In addition, some systems require tempering the ice block at ambient room temperature for periods up to half an hour prior to initiating shaving, as well as monitoring and adjusting the blade's height throughout a transitional period when starting to shave a new ice block (and sometimes continuously throughout shaving the entire ice block).

The ice-engaging mechanism must usually be spiked into the top surface to provide a good purchase, which can shatter an otherwise stable block of ice. Spiking can also erode or damage the top surface of the block, resulting in uneven downward pressure and non-uniform shaving. A block can also be fractured (without visible or noteworthy damage) during spiking, only to subsequently break apart or explode once the motor is engaged or the shaving process reaches a critical fissure. In such cases, the block must be replaced, and damage to the machine or injury to the operator can occur.

Because lowering the sharp edge of the blade to a protected or retracted position beneath the upper surface of the table requires operating the manual height adjustment mechanism—which is both time consuming and nullifies any prior optimized height adjustments—operators of many machines fail to lower the blades sufficiently (or at all) when changing blocks of ice. The presence and accessibility of the exposed blade results in many serious accidents, particularly because fluid adhesion between the remnant of an ice block and the tables' smooth surface requires significant force to overcome, with the remnant (and operator's fingers) sliding suddenly across the surface of the table when lateral force is applied to dislodge the remnant.

Some vertically-oriented ice shaving machines have completely exposed operating mechanisms, without protective guards or shields surrounding the drive head assembly, ice block, or upper surface of the table. Of the designs which do incorporate some physical barriers to protect the operator when the machine is running, mechanical safety interlocks linking closure of the safety guards to raising the blade or operating the drive of lift motors have not appeared in the marketplace. Only the most basic forms of electrical interrupts or kill switches have been utilized in the industry.

Vertical ice shaving machines in which the spindle descends relative to the table during the shaving process also present an exposed end of the rotating spindle above the drive head assembly. The spindle either protrudes perpendicularly a significant distance above the housing when the drive shaft is raised—resulting in noncompliance with local safety regulations and certification standards applicable to other types of industrial or commercial equipment—or requires an extremely large or inefficiently-shaped upper housing be retrofitted to enclose the spindle. Positioning the motor, a differential, and other components at the top of the machine (well above a rapidly spinning block of ice) makes the machines top-heavy and very unstable. In addition, the center of mass of the ice block is very seldom perfectly aligned with the axis of rotation—and may even shift significantly during shaving due to variations in the shape or density of the ice block—creating an unbalanced centrifugal force which further destabilizes the machine when the ice block is spun rapidly.

Consequently, the devices require a wider footprint and heavier base than would otherwise be necessary, utilize a shorter available stroke length to preserve stability, are difficult or dangerous to place in confined areas or along traffic patterns, are inconvenient to service, and will more readily permit moisture or other contamination to reach the spindle and interior of the drive head assembly through the open housing.

Moreover, these machines pose special obstacles to use in a commercial food preparation environment, such as the risk of injury to operators from the exposed spindle, and the need to enclose or isolate the moving mechanisms to prevent lubricants, dirt, or debris from being ejected onto dishware, utensils, or foodstuffs.

As such, the current commercially-available array of vertical ice shaving machines pose significant and unjustified risks to the operators' health and safety. These machines do not meet basic international safety requirements, and have not obtained conventional certification from the applicable regulatory and industry-approval bodies such as Underwriter's Laboratories (UL) without variation or divergence from their normal and meaningful safety and injury-prevention standards.

SUMMARY OF THE INVENTION

Briefly described, the invention comprises improvements in a vertically-oriented rotary ice shaving machine, and is depicted herein with reference to preferred embodiments in which the ice block is rotated relative to an intermediate table and stationary blade by a descending drive head assembly. The entire drive head assembly (including the portions of the ice-engaging mechanism, drive chain, and housing disposed above the table) descends toward the table from a raised position. No exposed spindle protrudes above the drive head assembly or its housing, nor descends relative to the drive head assembly or its housing. The drive head assembly may be carried on telescoping support columns, or on a vertically-reciprocating carriage. If the drive motor is disposed in the base of the machine, a telescoping drive shaft may be utilized to connect the motor to the drive linkages contained within the descending drive head assembly. Separate drive motors may be used to control the ice block rotating and drive head raising motions of the machine.

The drive head assembly may exert positive pressure on the ice block via tension exerted on the telescoping support columns, or due to gravity and the weight of the machine's descending components. A motor may also be used to return the drive head assembly to the raised position, employing any suitable mechanism including the telescoping support columns, a pulley assembly, or a lever system.

The blade is offset radially from the axis of rotation of the ice block to ensure that the shaving process occurs along the entire length of the blade without forming a localized "bearing" point supporting the ice block, and to maintain a uniform, parallel, and stable orientation between the blade and the lower surface of the ice block. The angled face forming the sharp edge of the blade is oriented away from the lower surface of the ice block (rather than being more parallel with that surface) so as to engage and "chisel" the ice more effectively, again resulting in a faster shaving process with more uniform quality shavings.

The blade is cammed between the disengaged (or retracted) and engaged (or extended) positions without disturbing any predetermined blade height adjustment. This camming or translational engagement allows the blade to be fully retracted to protect the operator from injury due to an exposed blade when inserting a block of ice or removing a remnant. The blade height may be manually adjusted to "fine tune" the shaving process as desired, but the height adjustment mechanism operates independently of the camming mechanism to negate repeatedly adjusting the blade height setting each time a new ice block is inserted.

A mechanical interlock associated with the camming mechanism prevents the blade from being raised to the exposed position until the protective doors are closed, and the protective doors cannot be opened unless the blade is retracted. Similarly, an electrical interlock interrupts operation of the motor(s) which raise and lower the drive head assembly or rotate the ice block unless the protective doors are closed.

The ice shaving machine of this invention has proven operable in shaving a conventional cylindrical ice block in one-half to one-fifth the time required by the best commercially-available machines, using comparable blade sizes and rotary speeds. Optimal blade height settings are on the order of one-half to one-quarter those of the best commercially-available machines, thereby producing far superior texture and quality to the shaved ice product without sacrificing preparation speed. While industry-standard vertical ice shaving machines generally utilize motors on the order of ⅓ horsepower (hp), the embodiments of the ice shaving machine shown herein operate quite suitably with 1/20 hp motor capacity (and ⅛–¼ hp with ample reserve) for both powering and raising the drive head assembly.

BRIEF DESCRIPTION OF THE DRAWINGS

FIG. 6 is a bottom partial cross section view of the table portion of the rotary ice shaving machine taken upwardly through line 6—6 in FIG. 2;

FIG. 7*a* is a diagrammatic view of the blade holder and adjustment mechanism of the rotary ice shaving machine in the extended position;

FIG. 7*b* is a diagrammatic view of the blade holder and adjustment mechanism of FIG. 7*a* in the retracted position;

FIG. 8*a* is a diagrammatic view of the ice block retaining clip of the rotary ice shaving machine in the retracted position;

FIG. 8*b* is a diagrammatic view of the ice block retaining clip of the rotary ice shaving machine in the extended position;

FIG. 11 is a partially broken away cross section view of the ice-engaging mechanism showing the independent spring-loaded pins.

DETAILED DESCRIPTION OF THE PREFERRED EMBODIMENTS

The ice shaving machine of this invention is illustrated in FIGS. 1–11 and referenced generally therein by the numeral 10.

Figure 1:
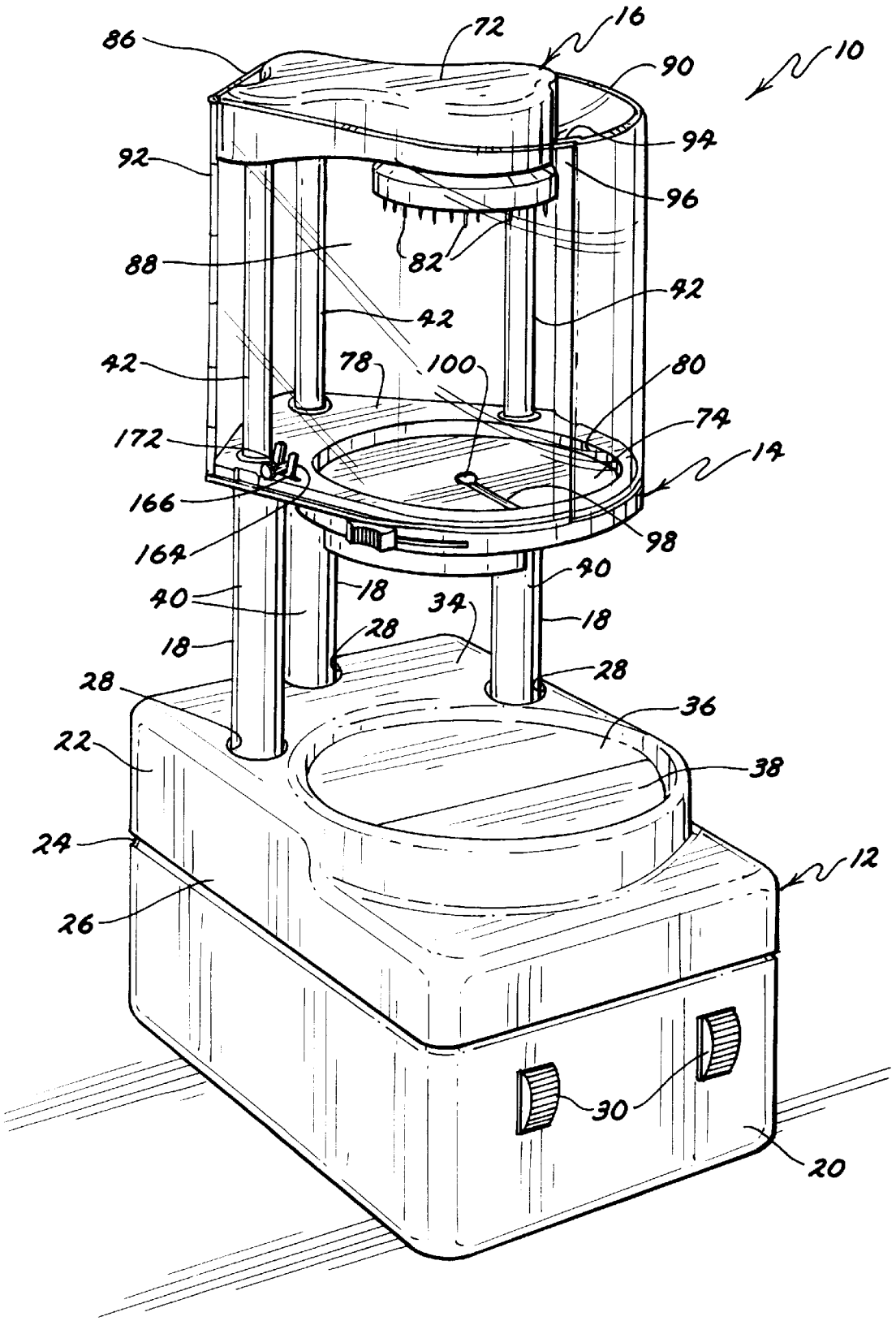
FIG. 1 is a front perspective view of a first embodiment of the rotary ice shaving machine of this invention.
Figure 2:
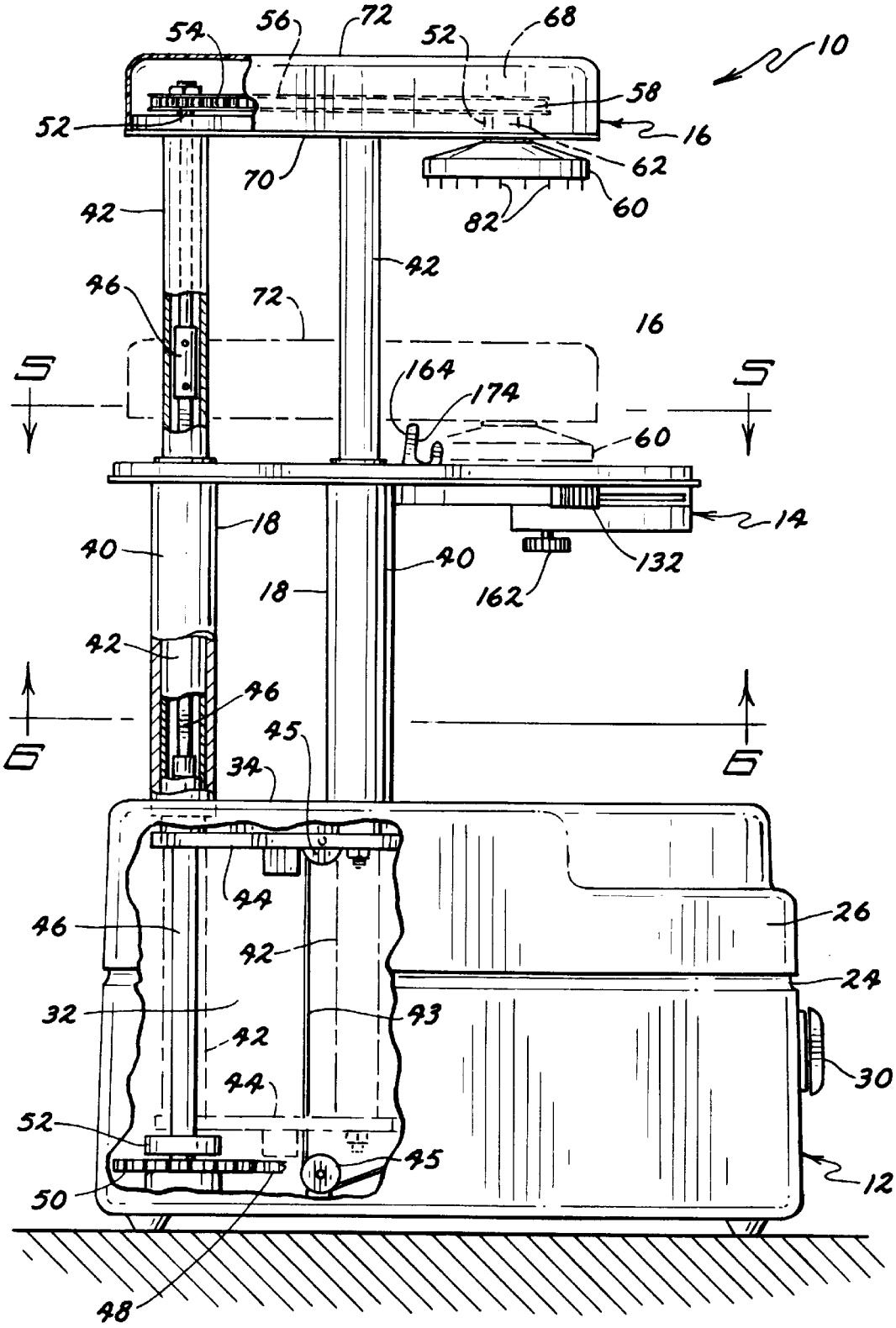
FIG. 2 is a partially broken away side view of the ice shaving machine of FIG. 1 showing the position and orientation of the base housing, drive head assembly, table, and telescoping support columns.

Referring particularly to FIGS. 1 and 2, one embodiment of the ice shaving machine 10 includes a base portion 12, a table portion 14, and a descending drive head assembly 16. The table portion 14 and drive head assembly 16 are mounted on three generally vertical supporting columns 18 which permit the drive head assembly 16 to reciprocate between a raised position as shown in FIGS. 1 and 2, and a lowered position proximate to the table portion 14 as shown by phantom lines in FIG. 2.

Referring again to FIGS. 1 and 2, the base portion 12 includes a lower housing 20 and an upper housing 22. The lower housing 20 defines an inwardly-recessed upper rim 24 which is snugly received within the depending skirt portion 26 of the upper housing 22. The upper housing 22 and lower housing 20 are each molded as separate but unitary pieces from a suitable thermoplastic material, and define apertures 28 in the upper housing 22 to receive the supporting columns 18, and in the lower housing 20 to accommodate forwardly-disposed control switches 30, as well as a power supply cord, foot-pedal control, diagnostic or other interfaces or connectors, and circuit breaker access in the rear. The upper housing 22 and lower housing 20 together provide a substantially drip-proof or leak-resistant enclosure protecting the interior region 32 and components therein, with suitable gaskets being utilized surrounding the apertures 28 in the upper housing 22 and as needed in association with the control switches 30, power supply cord, foot-pedal control, connectors, and circuit breaker access. The upper housing 22 and lower housing 20 may frictionally mate with one another, or may be removably connected using a plurality of conventional fasteners (not shown).

The upper housing 22 of the base portion 12 has a top surface 34 defining a recessed basin region 36 having a generally circular overall shape, and a forwardly-disposed angular depression 38. The basin region 36 provides a generally horizontal platform area on which a receptacle (not shown) may be rested, with the surrounding top surface 34 restraining the receptacle against lateral movement off from the platform area The angular depression 38 provides a drainage or sump area to collect shavings or fluid from melted chips of ice which are not contained within the receptacle.

Each of the three supporting columns 18 includes an outer tube 40 which extends between the base portion 12 and the table portion 14, and an inner tube assembly 42 at least partially received within the outer tube 40, and extending generally between the interior of the base portion 12 and the drive head assembly 16. Although generally cylindrical tubes 40, 42 are shown, the support columns 18 may conform to any desired cross-sectional shape, and may utilize sliding rails or alternately suitable configurations other than circumferentially-aligned tubes 40, 42. As described herein, the inner tube assemblies 42 may consist of separate mating inner and outer tubular segments, depicted as integral inner tube assemblies 42 in the drawing Figures for convenience.

The three supporting columns 18 are disposed more proximate to the rear of the ice shaving machine 10 and are arrayed in a suitable pattern (such as the isosceles triangle shown) to support and stabilize the table portion 14 and drive head assembly 16. The interaction between the outer tubes 40, inner tube assemblies 42, and their mounting structures provides structural integrity in excess of that required to merely support and stabilize either the table portion 14 or drive head assembly 16, and further provides a measure of redundancy or relational dynamics which enhances the durability and reliability of the moving components of the ice shaving machine 10.

The outer tubes 40 function as rigid, fixed spacers between the base portion 12 and table portion 14, and thereby prevent the table portion 14 from tilting, rotating, or twisting relative to the base portion 12. As such, the outer tubes 40 are attached to or securely engage both the base portion 12 and table portion 14 to reliably maintain the table portion 14 in its horizontal orientation, with sufficient vertical tension or compressive pressure being exerted between the outer tubes 40, table portion 14, and frame of the base portion 12 (such as by threaded connections or other conventional fasteners) to prevent the outer tubes 40 from tilting or twisting when vertical or lateral forces are applied to the front end of the table portion 14. It will further be appreciated that the outer tube 40 of at least the rearmost support column 18 can provide sufficient tension between the base portion 12 and table portion 14 to alone balance the normal forces exerted on the front end of the table portion 14 (with the outer tubes 40 of the two side support columns acting as a fulcrum), regardless of other forces or interactions which assist in maintaining the table portion 14 and drive head assembly 16 in their proper orientation. Alternately, the lower ends of the outer tubes 40 may be movably or adjustably mounted relative to the base portion 12 in order to permit variable spacing between the top surface 34 of the base portion 12 and the table portion 14 (either for incremental height adjustments or to accommodate different sizes of ice blocks), provided the adjustable mounting provides sufficient support and stability to maintain the support columns 18 in their substantially upright orientation and the table portion 14 in its horizontal orientation.

The inner tube assemblies 42 extend entirely through the outer tubes 40 and are interconnected to one another at the bottom ends thereof by a bracket 44, which in turn is pinioned to a lift linkage 43 using any suitable mounting or fastening scheme. Tensioning or compressive pressure is exerted on the inner tube assemblies 42 at both the upper and lower ends thereof, as further described below. The bracket 44 is connected to a section of the lift linkage 43 which extends generally vertically between a pair of spaced-apart drive wheels 45, as shown in FIG. 2. The lift linkage 43 (such as an endless-loop chain or belt) extends transversely from a drive motor (not shown) disposed within the interior region 32 of the base portion 12, and around the pair of drive wheels 45 (such as chain sprocket or pulley wheels) each positioned adjacent to either the lower and upper ends of the stroke path of the bracket 44 and lower ends of the inner tube assemblies 42 within the interior region 32 of the base portion 12.

Actuating or engaging the motor in one direction impels the lift linkage 43 to raise the bracket 44, inner tube assemblies 42, and drive head assembly 16 from the lowered position to the raised position. Conversely, reversing the rotation of the motor lowers the bracket 44, inner tube assemblies 42, and drive head assembly 16 from the raised position to the lowered position, under some degree of positive tension or pull which in turn exerts downward pressure on the ice block via the drive head assembly 16. Alternately, the direction of the lift linkage 43 may be reversed using a clutch or differential mechanism as opposed to reversing the rotational direction of the motor.

Disposed within the rearmost support column 18 is a multi-section, telescoping drive shaft 46 which is suitably sized and shaped to fit and extend within the hollow bore of the corresponding inner tube assembly 42 and outer tube 40. A first drive linkage 48 such as an endless-loop chain or belt extends from a drive motor (not shown) disposed within the interior region 32 of the base portion 12 around a first drive wheel 50 such as a chain sprocket or pulley wheel positioned adjacent the lower end of the drive shaft 46. The lower end of the drive shaft 46 is mounted on a bearing assembly 52 proximate to the bottom of the base portion 12. (It will be readily appreciated that separate drive motors and logic or control modules may be disposed within the base portion 12 and utilized for powering the lift linkage 43 and first drive linkage 48, and such a configuration has proven suitable and preferred in the particular embodiment described herein with reference to FIGS. 1–3. Alternately, a single drive motor may be utilized for powering both the lift linkage 43 and first drive linkage 48, however a more complex clutch or differential is then required to separate or isolate the two independent power functions, or permit reversing the rotational direction of the motor without adversely affecting the preferred modes of operation of the ice shaving machine 10.)

Referring again to FIGS. 2 and 3, a second drive wheel 54 is mounted adjacent the top end of the drive shaft 46, and carries a second drive linkage 56 such as an endless-loop chain or belt which extends forwardly and around a third drive wheel 58. The second drive wheel 54 and third drive wheel 58 are each similarly mounted on bearing assemblies 52 for rotation about an axis, the second drive wheel 54 being generally aligned with the common axis of rotation for the drive shaft 46 and first drive wheel 50, and the third drive wheel 58 being generally aligned with the axis of rotation of an ice-engaging mechanism 60 depending from the forward end of the drive head assembly 16. The third drive wheel 58 and ice-engaging mechanism 60 are operatively coupled by a drive connection 62 such as a shaft or projection extending downwardly from the third drive wheel 58 and bearing assembly 52. A tensioning wheel 64 mounted on a transversely-adjustable bracket 66 engages the second drive linkage 56 at a point disposed between the second drive wheel 54 and third drive wheel 58, and may be moved laterally inward or outward relative to a line extending between the axes of the second drive wheel 54 and third drive wheel 58 to tension or take up slack in the second drive linkage 56. The third drive wheel 58 is rotatably carried by and supported on a frame member 68 fixedly attached to a horizontal plate 70 which defines the lower surface of the drive head assembly 16 (apart from the ice-engaging mechanism 60 which depends below the plate 70). A drive head assembly housing 72 molded from a comparable thermoplastic material is removably mounted on the horizontal plate 70, either by a snap- or friction-fit, or using a plurality of conventional fasteners (not shown). The drive head assembly housing 72 encloses and protects the components of the drive head assembly 16 described above.

The top ends of the inner tube assemblies 42 of the two outer support columns 18 are connected or attached to the horizontal plate 70 using any suitable mounting scheme, in a manner corresponding functionally to the connection between the lower ends of the inner tube assemblies 42 and the bracket 44. As a representative example, the inner tube assemblies 42 may each consist of an innermost tube connected to both the horizontal plate 70 and bracket 44 using threaded connections or fasteners 76, and an intermediate tube circumscribing the innermost tube which maintains a fixed spacing between the horizontal plate 70 and bracket 44. In such a configuration, the innermost tube and fasteners 76 generally exert pressure compressing the horizontal plate 70 and bracket 44 against the intermediate tube, although an inverse arrangement can be utilized. The inner tube assemblies 42 (including both the innermost and intermediate tubes) therefore slide or "telescope" reciprocally within the outer tubes 40 as the bracket 44 is raised and lowered by the lift linkage 43 and associated motor. The dimensional tolerances between the inner tube assemblies 42 and outer tubes 40 are such that the corresponding pairs of tubes 40, 42 remain substantially aligned longitudinally with one another, and may either directly contact and slidingly engage one another, or may include bearing assemblies which maintain the tubes 40, 42 in alignment while permitting smooth and effectively frictionless movement.

The motors and lift or drive linkages 43, 48, 56 may be of any conventional type suitable for operation as intended in the applications described herein, with one-eighth to one-quarter horsepower (hp), high torque, reversibly DC electric motor and polymeric linked-chain drive belts having proven suitable. One-twentieth hp motors have proven workable to power both the lift and drive functions, however the one-eighth to one-quarter hp range does not adversely affect design or manufacturing efficiency or cost, and provides ample reserve power. Motors up to one-third hp (as commonly found in other conventional vertical ice shaving machines) may be utilized if desired, but motors in excess of this power capacity generally exhibit no advantage when employed in the embodiments of the ice shaving machine 10 described herein. Distinct gear ratios or motor speeds can be used to achieve different rates of rotation, ascent, or descent in operation.

The table portion 14 presents a generally horizontal, planar ice supporting surface 74 having a circular shape aligned beneath the axis of rotation of the ice-engaging mechanism 60. The ice supporting surface 74 is generally smooth, so as to produce a minimum of friction or irregularities to impede uniform rotation of an ice block resting thereon. The ice supporting surface 74 may define or include a plurality of spaced-apart, concentric rings marked or etched thereon to assist in properly positioning and aligning the ice block relative to the rotational axis of the ice-engaging mechanism 60 and the center point of the ice supporting surface 74. These concentric rings may have any desired spacing, such as one-quarter to one-half inch measured radially.

The ice supporting surface 74 is also recessed relative to the top surface 78 of the table portion 14, such that a generally circular retaining lip 80 having a height on the order of a half inch is formed surrounding the ice supporting surface 74. The ice-engaging mechanism 60 includes a plurality of downwardly-projecting, spring-biased ice engaging pins 82 which contact the top end of the ice block, and serve to hold the ice block in axial alignment on the ice supporting surface 74 and maintain rotation of the ice block at the same angular speed as the ice-engaging mechanism 60. Referring particularly to FIG. 11, each of the pins 82 has a sharpened bottom end, the bodies and top ends of the pins 82 being received within and restrained by structures within the interior of the ice-engaging mechanism 60. The ice-engaging mechanism 60 provides an equal plurality of sleeves or apertures within which the pins 82 are slidably received, each pin 82 being urged downwardly by a coiled compression spring 84 or similar spring biasing force. The pins 82 each move independently relative to the ice-engaging mechanism 60 and one another, so as to conform to the irregular shape of the top of the ice block (thus exerting more uniformly dispersed pressure on the ice block, and mitigating against the ice block tipping or wobbling during the shaving process or shattering during spiking).

The area between the table portion 14 and drive head assembly 16 is partially enclosed by a rear shield 86 and a pair of pivoting front doors 88, 90. The rear shield 86 and front doors 88, 90 completely surround the area above the table portion 14 and beneath the drive head assembly 16 in the horizontal direction, although the shape of the drive head assembly 16 may leave an opening between the drive head assembly 16 and the front doors 88, 90 in the vertical direction. Although the peripheral edge of the drive head assembly 16 may closely confront the rear shield 86 and front doors 88, 90, sufficient clearance is provided so that the drive head assembly 16 may descend within the area bounded by the rear shield 86 and front doors 88, 90 without scratching or marring the front doors 88, 90. A secondary housing or enclosure (not shown) may be disposed over the drive head assembly housing 72 that is mounted on the horizontal plate 70, the front edge of that secondary housing extending forwardly towards the doors 88, 90 and closely confronting their inner surfaces to more fully enclose the area between the table portion 14 and drive head assembly 16, and prevent an operator from reaching their fingers between the drive head assembly 16 and doors 88, 90. That secondary housing may be attached or connected to the rear shield 86 using any suitable fastening scheme and remain at a stationary or fixed height relative to the table portion 14 and doors 88, 90, or may be mounted on the drive head assembly 16 (or the primary housing 72) and move vertically along with the drive head assembly 16 in the region bounded by the rear shield 86 and doors 88, 90. Alternately, the drive head assembly housing 72 may include a forwardly-projecting flange or barrier extending towards the doors 88, 90 and closely confronting their inner surfaces to provide a similar enclosure.

The front doors 88, 90 each pivot on generally vertical hinges 92 disposed along the rear edge of each of the front doors 88, 90 into overlapping contact when closed, with one of the front doors 90 including a recessed flange or lip portion 94 which is offset rearwardly to receive the front edge 96 of the opposing door 88 when closed.

Referring particularly to FIGS. 1–6, the planar ice supporting surface 74 of the table portion 14 defines a radial slot 98 which intersects and communicates with a central aperture 100, both the slot 98 and aperture 100 extending through the ice supporting surface 74 such that the area disposed above the ice supporting surface 74 communicates with the area disposed beneath the table portion 14 adjacent the slot 98 and aperture 100. The aperture 100 has a generally circular shape and is aligned with the radial axis of the ice supporting surface 74 and the axis of rotation of the ice-engaging mechanism 60. The aperture 100 has a diameter slightly greater than the width of the slot 98, with the longitudinal centerline of the slot 98 being offset from the radius of the ice supporting surface 74 and aperture 100, such that one longitudinal edge 102 of the slot 100 is disposed more closely proximate to the axis of rotation 104 or center point of the aperture 100, and the opposing longitudinal edge 106 is disposed more closely proximate to tangential alignment with the peripheral edge of the aperture 100.

Figure 5:
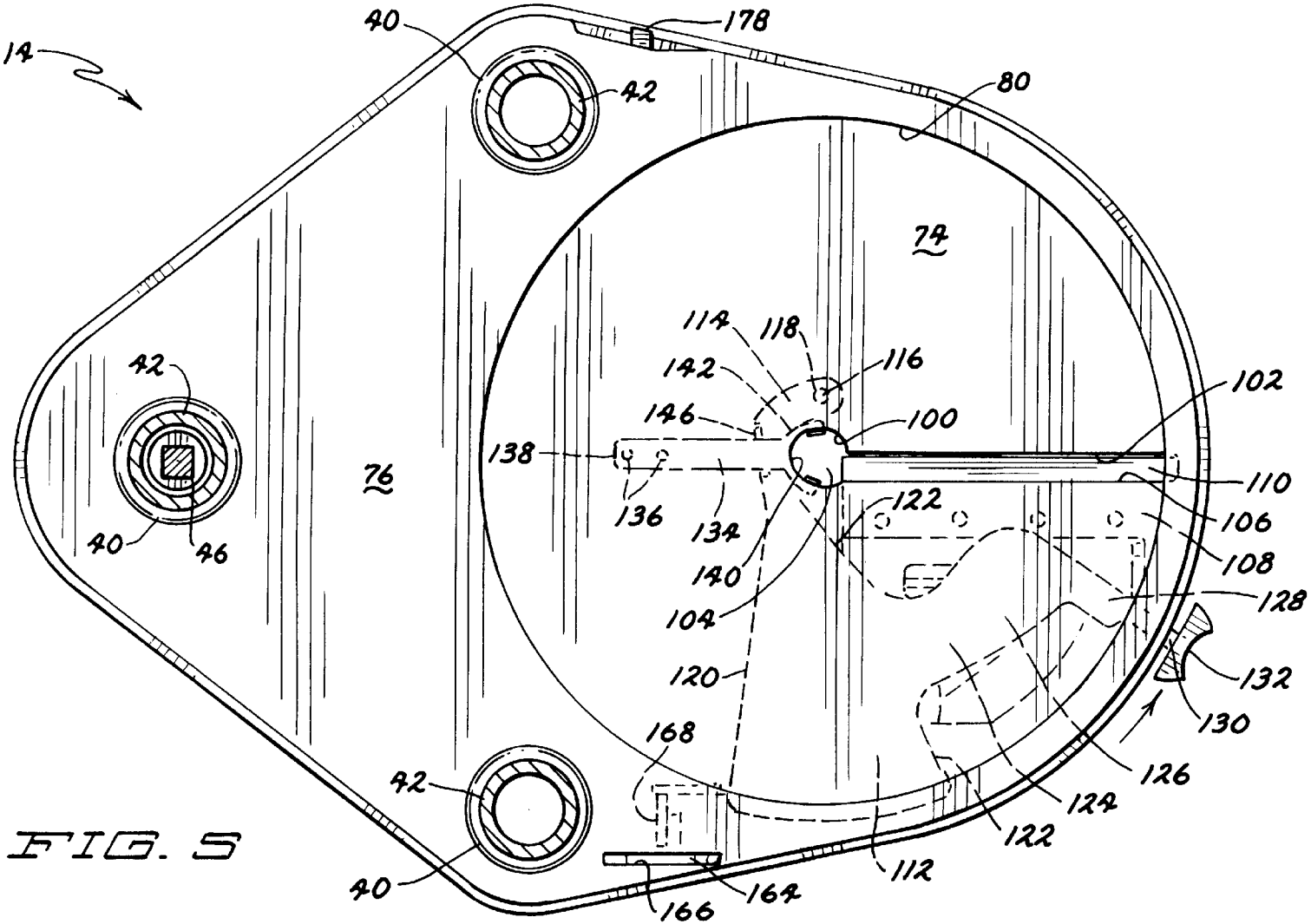
FIG. 5 is a top partial cross section view of the table portion of the rotary ice shaving machine taken downwardly through line 5—5 in FIG. 2.
Figure 5:
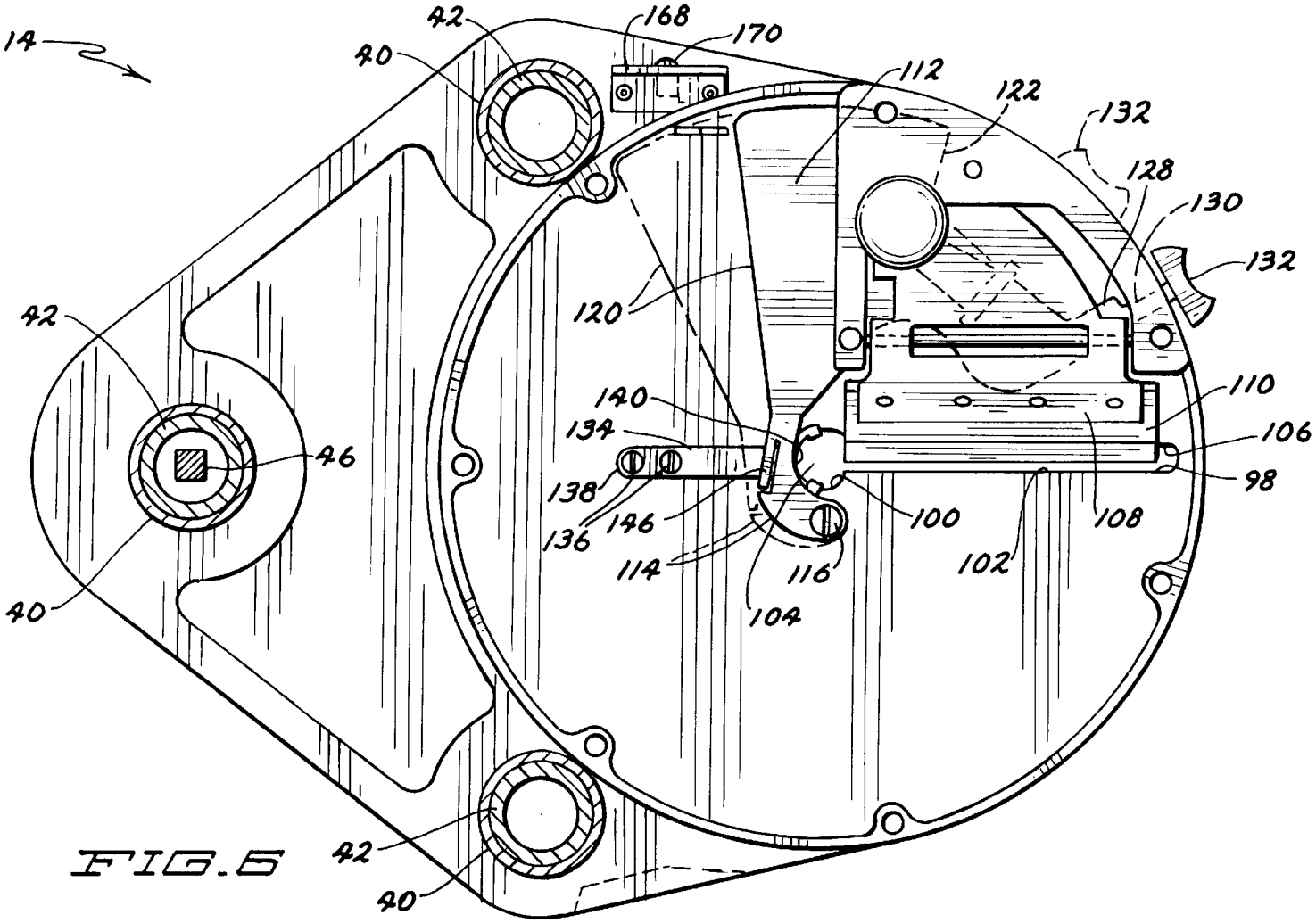

Referring particularly to FIGS. 5 and 6, disposed beneath the ice supporting surface 74 is a moveable blade holder mechanism 108 which receives and retains an ice shaving blade 110. The blade 110 has a length which is generally less than the length of the slot 98 plus the radius of the circular aperture 100 combined. The blade 1 10 is oriented generally parallel with the slot 98, and positioned and disposed so that its radially-inner edge is spaced a distance outwardly from the axis of rotation 104 of the ice-engaging mechanism 60 and inwardly from the peripheral edge of the circular aperture 100, but more closely proximate the peripheral edge of the circular aperture 100 than the center point of the circular aperture 100 or axis of rotation 104 of the ice-engaging mechanism 60. A spacing on the order of one-quarter inch or more, and in particular one-quarter to one-half inch, from the axis of rotation, has proven workable. A smaller offset, on the order of one-quarter inch, reduces the diameter of the core and thereby increases the rate at which the core flakes away or melts.

Also disposed beneath the ice supporting surface 74 is an armature mechanism 112. The armature mechanism 112 is fabricated from an irregularly shaped plate or body which includes a first projection 114, with the armature mechanism 112 being pivotably mounted to the lower side of the ice supporting surface 74 by a conventional threaded fastener 116 extending through an aperture 118 at the distal end of the projection 114. The pivotal axis of the armature mechanism 112 is displaced radially relative to the axis of rotation 104 of the ice-engaging mechanism 60 or center point of the circular aperture 100 in the ice supporting surface 74. The body of the armature mechanism 112 includes a rear edge 120 which extends radially outward and terminates closely proximate to the peripheral edge of the table portion 14, and a front edge 122 defined by two segments separated by a second projection 124 extending generally perpendicularly therefrom. The second projection 124 has a generally L-shaped configuration including a first leg 126 which extends forwardly from the body of the armature mechanism 112 generally circumferential relative to the pivotal axis of the armature mechanism 112, and a second leg 128 which extends radially outward beyond the periphery of the table portion 14 to present an exposed distal end 130. A contoured knob 132 is mounted on the distal end 130 of the second leg 128 of the armature mechanism 112, such that the knob 132 is spaced a distance from the outer peripheral surface of the table portion 14 and moves arcuately along a path adjacent the outer peripheral surface of the table portion 14 when the armature mechanism 112 is pivoted forward and backward between fully-forward and fully-rearward positions, as shown in FIG. 6. The contoured knob 132 includes a concave thumb-engaging recess bounded by two projecting portions which extend radially outward relative to the pivotal axis of the armature mechanism 112.

Referring particularly to FIGS. 5, 6, 8A, and 8B, also attached to the underside of the ice supporting surface 74 in a position generally opposing the slot 98 and oriented radially relative to the circular aperture 100 is a flexible tang member 134. The tang member 134 is fabricated from a thin sheet of metal and is mounted to the ice supporting surface 74 using a pair of conventional threaded fasteners 136 disposed adjacent the proximal end 138 of the tang member 134, the distal end 140 of tang member 134 defining a pair of semicircular projections 142 each extending around and aligned with the peripheral edge of the circular aperture 100 from opposing sides of the tang member 134. Extending generally vertically upward from the distal tip of each of the semicircular projections 142 is an ice-engaging prong 144. The proximal end 138 of the tang member 134 is mounted to a projection which depends from the underside of the table portion 14 to permit the central portion of the tang member 134 to flex upwardly toward the underside of the table portion 14 as shown in FIG. 8A.

Referring particularly to FIGS. 6, 8A, and 8B, the armature mechanism 112 defines an upwardly-projecting flange 146 cut into the rear edge 120 of the armature mechanism 112 and bent upwardly relative thereto to present an angled surface contacting the body portion of the tang member 134, the flange 146 being positioned and oriented to engage the tang member 134 and press it into an operative position raising the ice-engaging prongs 144 when the armature mechanism 112 is pivoted to the forward or blade-retracted position. The ice-engaging prongs 144 have a height greater than the thickness of the ice supporting surface 74, such that depressing the body of the tang member 134 towards the underside of the ice supporting surface 74 causes the tips of the ice-engaging prongs 144 to protrude or project through the circular aperture 100 and above the ice supporting surface 74 sufficiently to engage a block of ice resting thereon as shown in FIG. 8B, and prevent that block of ice from rotating or sliding radially.

Referring particularly to FIGS. 5, 6, 7A, and 7B, the blade holder mechanism 108 is pivotally mounted to the table portion 14 beneath the ice supporting surface 74, and pivots about an axis 148 such as a shaft extending generally horizontally through the body of the blade holder mechanism 108 and received within bores in opposing support sections attached to or formed by the underside of the ice supporting surface 74. The blade holder mechanism 108 pivots between a fully-retracted position in which the tip 150 of the blade 110 is disposed beneath the planar ice supporting surface 74 and generally within or beneath the slot 98 as shown in FIG. 7B, and a fully-extended position in which the tip 150 of the blade 110 is disposed a predetermined and selectively adjusted distance above the planar ice supporting surface 74 as shown in FIG. 7A. The blade holder mechanism 108 is moved between the fully-retracted and fully-extended positions by pivoting or rotating the armature mechanism 112. When the armature mechanism 112 is pivoted from the forward position to the rearward position, an angled block 152 attached to the underside of the body of the armature mechanism 112 moves rearwardly into contact with an angled extension plate 154 mounted on the top of the blade holder mechanism 108. The angled extension plate 154 is disposed on the rear end of the blade holder mechanism 108 opposing the blade 110, such that increasing downward pressure exerted on the angled extension plate 154 by the passing angled block 152 on the armature mechanism 112 urges the angled extension plate 154 and rear end of the blade holder mechanism 108 downward, thus causing the blade holder mechanism 108 to pivot about the axis 148 and raise the blade 110 relative to the ice supporting surface 74. The blade holder mechanism 108 is spring-biased toward the fully-retracted position, so as to urge the tip 150 of the blade 110 to a position below the planar ice supporting surface 74 in the absence of pressure exerted on the rear of the blade holder mechanism 108 by the angled block 152 and armature mechanism 112. Conversely, pivoting the armature mechanism 112 forwardly disengages the angled block 152 from the angled extension plate 154 and rear end of the blade holder mechanism 108, thus permitting the spring-biasing force to pivot the rear end of the blade holder mechanism 108 upwardly and moving the tip 150 of the blade 110 to the fully-retracted position.

The angled extension plate 154 is pivotally attached to the blade holder mechanism 108 and pivots about an axis 156 such as a shaft extending generally horizontally through the body of the blade holder mechanism 108, permitting the predetermined height between the tip 150 of the blade 110 and the planar ice supporting surface 74 in the fully-extended position to be selectively adjusted by changing the relative angle or orientation between the angled extension plate 154 and the blade holder mechanism 108 (and thus the angled block 152 on the armature mechanism 112). This adjustment may be accomplished by rotating a threaded shaft 158 which extends through a matingly-threaded collar 160 on the rear end of the blade holder mechanism 108, the distal end of the threaded shaft 158 contacting the free end of the angled extension plate 154, and the proximal end of the threaded shaft 158 being fitted with a knurled knob 162. The knurled knob 162 may be grasped and rotated in either the clockwise or counterclockwise direction by the user to set the predetermined height between the tip 150 of the blade 110 and the planar ice supporting surface 74 in the fully-extended position. This predetermined height adjustment is then substantially unaffected by subsequently and repeatedly moving the blade holder mechanism 108 and blade 110 back and forth between the fully-retracted and fully-extended positions.

Referring again to FIGS. 1–6, a mechanical interlock mechanism 164 is mounted on the table portion 14 in a generally vertical orientation relative to, and extending partially through a slot 166 defined by, the planar ice supporting surface 74 proximate the hinge 92 of the front door 88. The mechanical interlock mechanism 164 is connected to a support member 168 disposed on the underside of the ice supporting surface 74, and pivots freely about a generally horizontal axis 170 between a fully-raised position in which the open C-shaped channel 174 of the interlock mechanism 164 is disposed facing upward (as shown in FIG. 2 and by phantom lines in FIG. 4) and a fully-lowered position in which the open C-shaped channel 174 of the interlock mechanism 164 is disposed facing forward and generally parallel to or coplanar with the top of the ice supporting surface 74 (as shown in FIG. 4).

Figure 3:
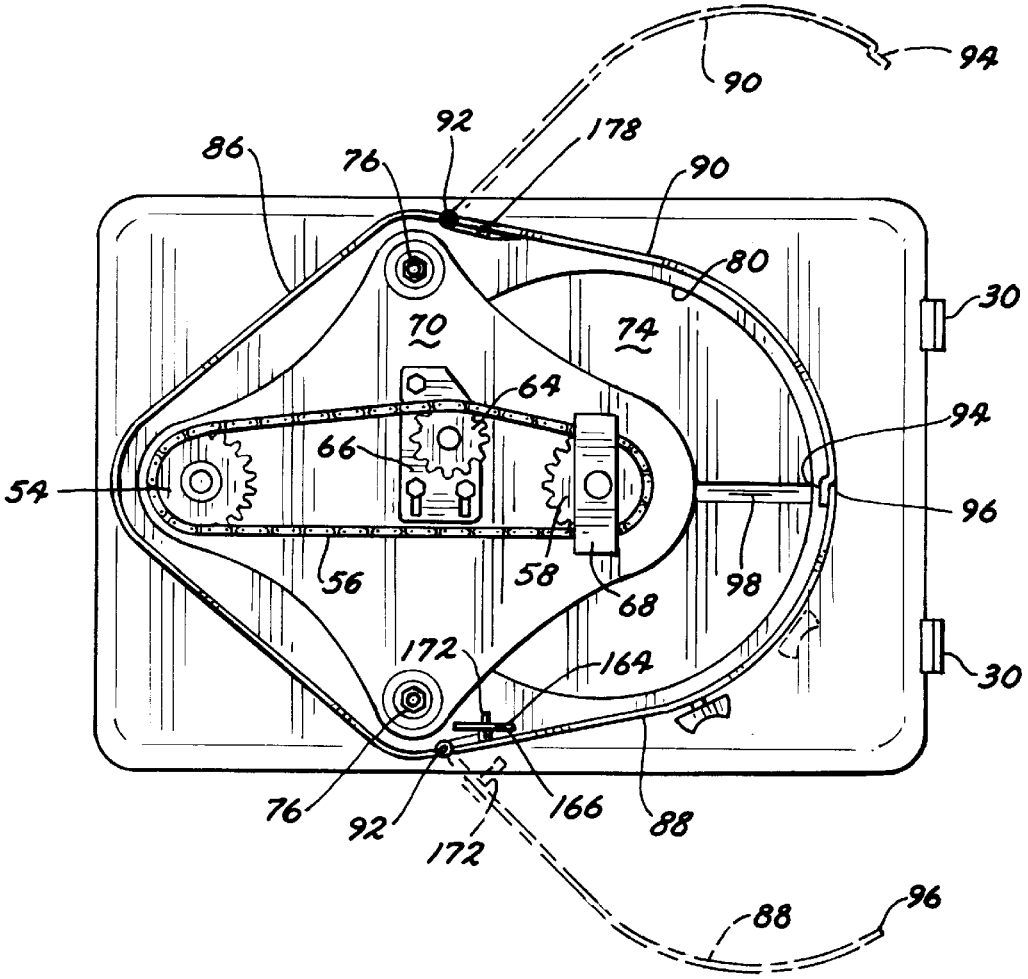
FIG. 3 is a top view of the rotary ice shaving machine of FIGS. 1 and 2 with the housing covering the drive head assembly removed.

Referring particularly to FIGS. 1 and 3, the front door 88 (presenting the outwardly-disposed front edge 96 when the doors 88, 90 are closed) includes an inwardly-projecting engagement member 172 which is positioned and aligned to be received within the open C-shaped channel 174 of the mechanical interlock mechanism 164 when the door 88 is moved from the open position (shown by phantom lines in FIG. 3) to the closed position. When the door 88 is moved to the completely closed position as shown in FIGS. 1 and 3, the inwardly-projecting engagement member 172 contacts the upper leg 176 of the mechanical interlock mechanism 164 and pivots the mechanical interlock mechanism 164 to the raised position, as shown in FIGS. 1–3 (and by phantom lines in FIG. 4).

Figure 4:
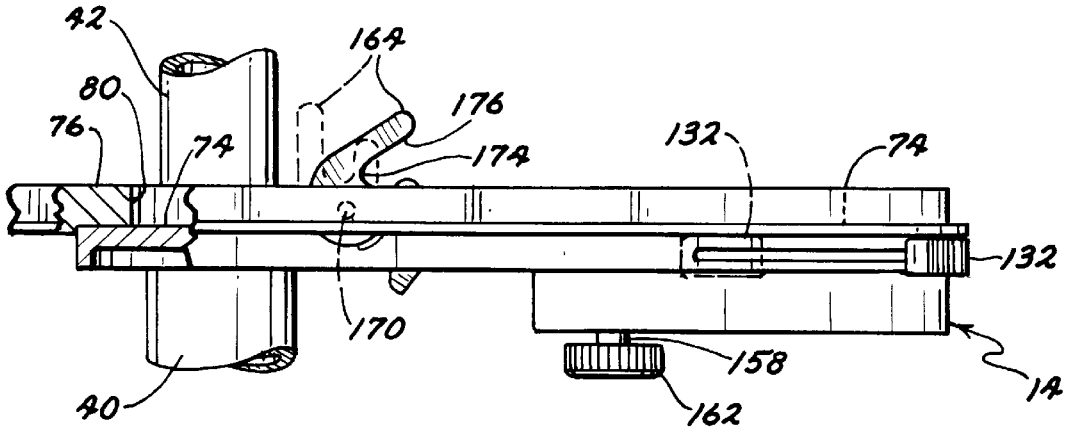
FIG. 4 is a side elevation view of the table portion of the rotary ice shaving machine.

Referring particularly to FIGS. 4 and 6, a portion of the mechanical interlock mechanism 164 disposed beneath the ice supporting surface 74 is aligned with and depends sufficiently so as to contact the rear edge 120 of the armature mechanism 112 when the mechanical interlock mechanism 164 is in the lowered position. As such, the mechanical interlock mechanism 164 prevents the armature mechanism 112 from being pivoted rearwardly to raise and expose the tip 150 of the blade 110 from the retracted position unless the door 88 is in the closed position and the mechanical interlock mechanism 164 is pivoted to the raised position. Conversely, when the door 88 is in the closed position and the mechanical interlock mechanism 164 is pivoted to the raised position, sufficient clearance is provided between the depending portion of the mechanical interlock mechanism 164 and the rear edge 120 of the armature mechanism 112 to permit the armature mechanism 112 to be pivoted rearwardly to raise and expose the tip 150 of the blade 110 to the extended position. As noted above, with the armature 112 pivoted to the rear or blade-extended position, the mechanical interlock mechanism 164 cannot be pivoted forwardly and downwardly due to the location of the armature 112, thus preventing the doors 88, 90 from being opened.

It may be readily appreciated that the mechanical interlock mechanism 164 may take a variety of divergent forms depending on the configuration of several components, including the position, orientation, structure, and function of the blade holder mechanism 108, armature mechanism 112, and doors 88, 90.

Referring particularly to FIGS. 3 and 5, an electrical interlock mechanism 178 is disposed on the other side of the table portion 14 opposing the mechanical interlock mechanism 164 and located generally proximate to the hinge 92 of the inner door 90. The electrical interlock mechanism 178 includes a sensor or switch such as a pressure- or proximity-activated device which is actuated or deactuated by the door 90 being pivoted to or from its closed position. The electrical interlock mechanism 178 is operatively coupled by wires or other conduits to the electronic control system of the ice shaving machine 10, and deactivates the power supply to the motor or other elements of the control system when the door 90 is displaced a predetermined distance from its closed position. Alternately, the electrical interlock mechanism 178 may take a variety of divergent forms depending on the control and power systems being utilized (such as pneumatic, hydraulic, or others), and the placement and operation of the electric interlock mechanism 178 may depend on the configuration of several components, including the position and orientation of the doors 88, 90, electrical wiring, motor, and control or logic system. As such, the electrical interlock mechanism 178 may be adapted to provide a general control system interlock mechanism 178 which is partially or wholly non-electrical in structure and function, and instead relies on other signal-and-response technology to interrupt operation of the ice shaving machine 10 in the vent one or both doors 88, 90 are dislodged from their closed and protective positions.

In operation, an ice shaving blade 110 is initially mounted within the blade holder mechanism 108 and the predetermined height for the tip 150 of the blade 110 relative to the top of the ice block supporting surface 74 is set or adjusted (either by the operator, during manufacturing, or by service personnel). Referring particularly to FIGS. 7A and 7B, the blade 110 includes an upper planar surface 180 and a lower planar surface 182 which are generally parallel with one another, and are each bisected by an angled surface 184 which defines the sharpened tip 150. The angled surface 184 extends at a generally acute angle relative to the upper planar surface 180 of the blade 110 (and therefore a generally obtuse complimentary angle relative to the lower planar surface 182 of the blade 110). The angled surface 184 is disposed facing away from the surface of the ice block contacting the tip 150 of the blade 110 and being shaved, and hence downward relative to the ice block supporting surface 74. The blade 110 may be either fixedly or removably mounted on the blade holder mechanism 108 using any suitable attachment mechanism or fasteners.

The ice shaving machine 10 is connected to a conventional power supply, and one of the forwardly-disposed control switches 30 is actuated by the operator to raise the drive head assembly 16 to the fully raised position relative to the table portion 14 as shown in FIG. 1. The armature mechanism 112 is moved to the forward position such that the blade 110 is in the retracted position (with the tip 150 of the blade 110 not being exposed above the planar ice supporting surface 74). The doors 88, 90 are moved to the fully opened position, so that the mechanical interlock mechanism 164 prevents the armature mechanism from being moved to the rearward position (raising the blade 110 to the extended position), and the electrical interlock mechanism 178 prevents the control system from being actuated to rotate the ice-engaging mechanism 60. A suitably shaped and sized block of ice is placed through the open doors 88, 90 onto the ice supporting surface 74, and the ice block is engaged by the upwardly extending prongs 144 of the tang member 134 to prevent it from rotating or sliding on the ice supporting surface 74.

Once the ice block is positioned and engaged as desired, the operator closes the doors 88, 90, thus actuating the mechanical interlock mechanism 164 and electrical interlock mechanism 178.

The appropriate control switch 30 is then activated by the operator to lower or "spike" the ice-engaging mechanism 60 into engaging contact with the top surface of the block of ice, all or a substantial percentage of the spring-biased pins 82 contacting the ice block and being depressed relative to the ice-engaging mechanism 60 to conform to any contour presented by the top surface of the ice block. The operator can then pivot the armature mechanism slightly rearwardly to lower and disengage the prongs 144 of the tang member 134, thereby permitting the ice block to rotate in an unrestricted manner.

The operator may then actuate the other control switch 30, which operates the motor and impels the drive head assembly 16 to spin the ice blocking engaging mechanism 60 up to a predetermined rotational speed relative to the blade 110 for shaving. Downward pressure may also be applied via the drive head assembly 16. It may be appreciated that one control switch 30 may regulate the vertical movement of the drive head assembly 16 while the other control switch 30 independently regulates the rotation of the ice-engaging mechanism 60, or the logic and control system of the ice shaving machine 10 may be configured so that the first control switch 30 regulates the vertical movement of the drive head assembly 16 only during raising the drive head assembly 16 and spiking the ice block, while the second control switch 30 regulates both rotational movement and downward pressure of the ice-engaging mechanism 60 during the shaving process.

With the ice block rotating at the desired speed, the operator can then pivot the armature mechanism rearwardly to bring the angled block 152 attached to the underside of the armature mechanism 112 into contact with an angled extension plate 154 mounted on the top of the blade holder mechanism 108 to raise the tip 150 of the blade 110 from the retracted position to the predetermined height above the ice supporting surface 74 as previously selected and adjusted by the operator. Moving the armature mechanism 112 rearwardly further disposes a portion of the armature mechanism 112 beneath and in close proximity to the bottom of the mechanical interlock mechanism 164, thus preventing the mechanical interlock mechanism 164 from pivoting forward or the doors 88, 90 from being opened until the armature mechanism 112 is pivoted completely forward (thus lowering the blade 110 to the retracted position).

As the blade 110 engages the lower surface of the rotating block of ice, ice shavings begin to be deposited through the slot 98 and into a receptacle disposed within the recessed basin region 36 of the base portion 12. The operator may utilize one hand to operate the control switch 30 and the other hand to hold and rotate or tip the receptacle, or the ice shaving machine 10 may utilize a conventional foot control to activate rotation of the ice-engaging mechanism 60 and ice block (such as a pneumatic foot pump coupled by a closed tube to a pneumatic-to-electrical solenoid switch at the rear of the base portion 12).

Due to the speed at which the ice shaving machine 10 shaves and deposits ice (even operating at rotational speeds comparable to or less than conventional machines), the machine 10 is normally operated in very short increments or bursts when the operator is producing shaved ice for a single serving receptacle, and the use of a foot control may be preferred or necessary.

Because the blade 110 is spaced apart from the axis of rotation 104, a cylindrical core of unshaved ice may begin to extend or depend downwardly through the circular aperture 100 behind the peripheral edge of the receptacle. In practice, this core has a natural tendency to break or flake apart into small chunks within the basin region 36 and melt into the depression 38.

Once a block of ice has been substantially depleted, the operator may deactivate the control switch 30 to stop rotation of the ice-engaging mechanism 60, and pivot the armature mechanism 112 forward to move the blade 110 to the retracted position (as well as elevate the ice-engaging prongs 144). The blade 110 may also be retracted prior to slowing or stopping the rotation of the remnant, however the ice-engaging prongs 144 should not be extended until after the remnant has stopped rotating. The drive head assembly 16 may be raised, the armature mechanism 112 moved forward so that the doors 88, 90 can be opened (thus causing the electrical interlock mechanism 178 to deactivate the control system so that the ice-engaging mechanism 60 cannot be inadvertently rotated or the drive head assembly 16 lowered), and the remnant of the ice block removed from the ice block supporting surface 74. If the ice engaging prongs 144 do not lift or dislodge the remnant or completely break the surface tension between he remnant and the ice block supporting surface 74, the operator may grasp the remnant and slide or lift it without risk of cutting their fingers on the retracted blade 110.

Figure 9:
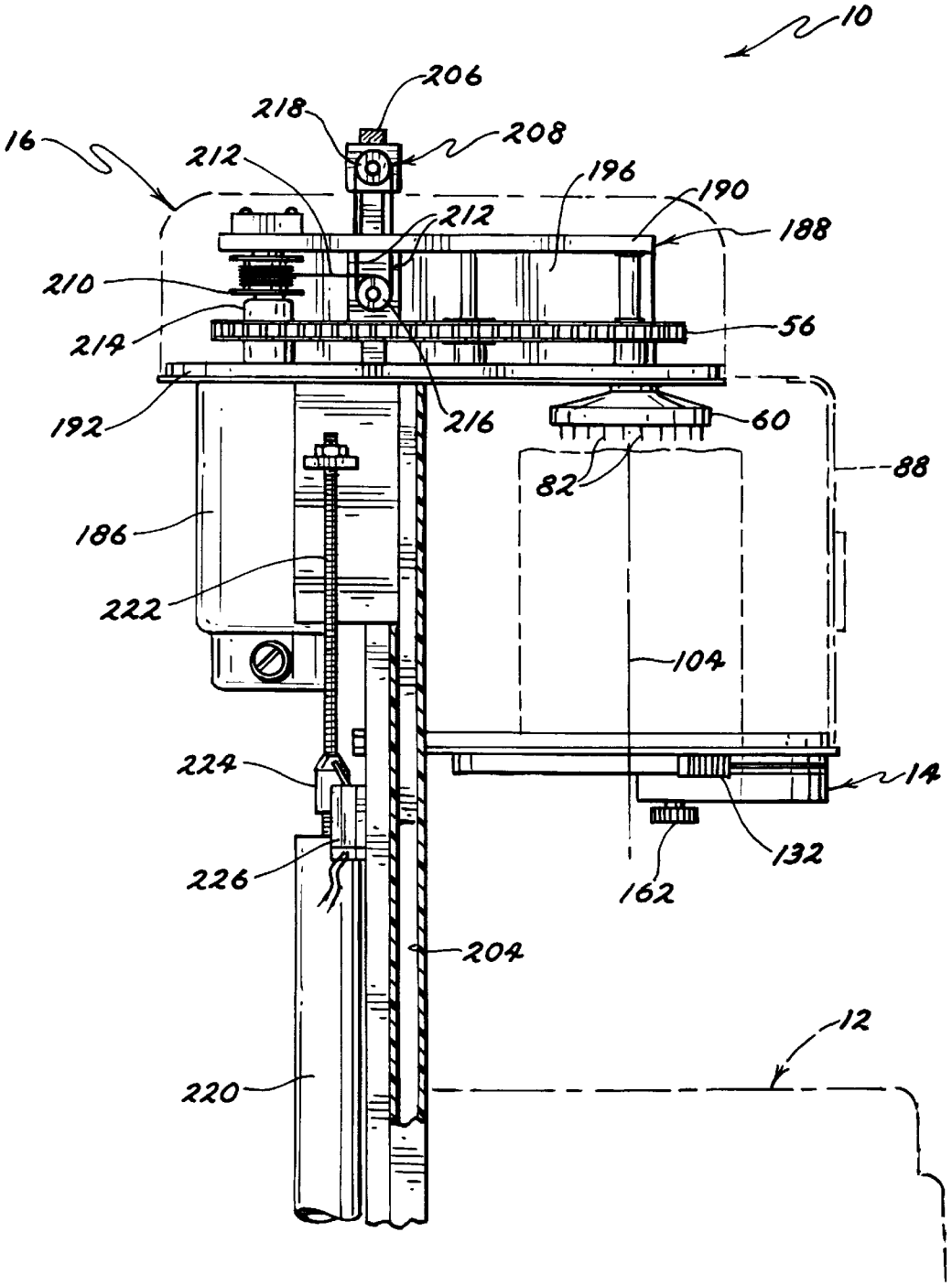
FIG. 9 is a partially broken away side elevation view of an alternate embodiment of the rotary ice shaving machine of this invention, showing the position and orientation of the base housing, drive head assembly, table, and drive head support assembly.
Figure 10B:
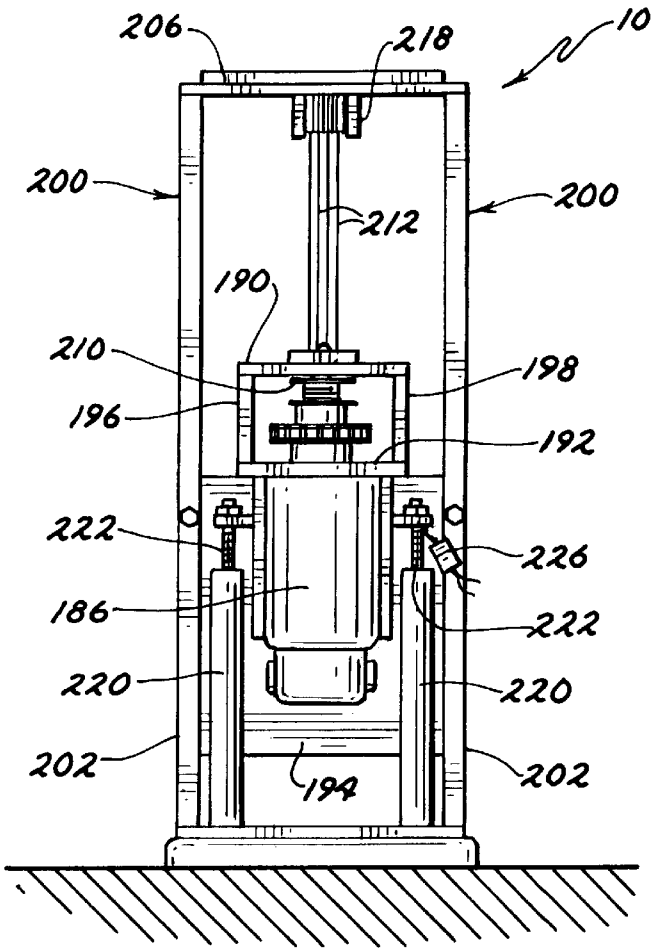
FIG. 10*b* is a rear elevation view of the embodiment of the rotary ice shaving machine shown in FIG. 10*a* with the motor, carriage assembly, and drive head assembly in the lowered position.
Figure 10A:
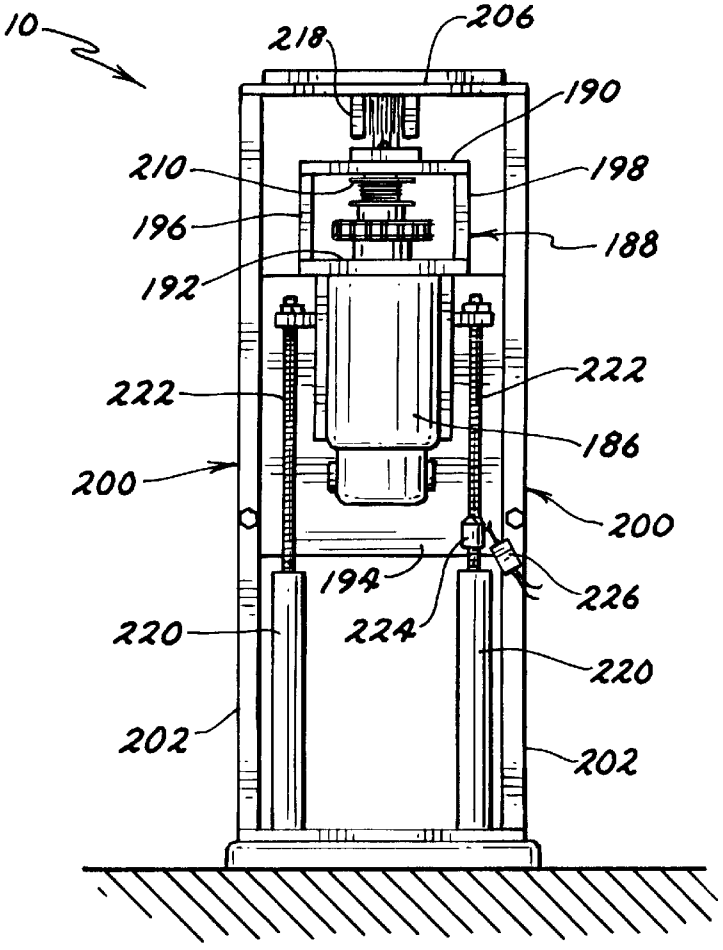
FIG. 10*a* is a rear elevation view of the embodiment of the rotary ice shaving machine shown in FIG. 9 with the motor, carriage assembly, and drive head assembly in the raised position.

Referring particularly to FIGS. 9, 10A, and 10B, an alternate embodiment or configuration of certain components the ice shaving machine 10 are shown for exemplary purposes. In this alternate embodiment, the motor 186 is disposed proximate to the rear of the ice shaving machine 10 and moves reciprocally up and down with the drive head assembly 16 between raised and lowered positions. The motor 186 is mounted to a carriage assembly 188 which includes upper and lower generally horizontal deck plates 190, 192, a generally vertical backing plate 194, and side plates 196, 198 extending between and connecting the upper and lower deck plates 190, 192. The motor 186 is attached either to the underside of the lower deck plate 192, or the rear face of the vertical backing plate 194, or both. The carriage 188 is slidably mounted on a frame 200 which includes generally vertical risers 202 which define channels 204 to receive either the side edges of the backing plate 194 or other projections extending outwardly from the carriage 188. The frame 200 also includes a header 206 which extends across between the top ends of the risers 202 and above the drive head assembly 16.

The drive head assembly 16, carriage 188, and motor 186 are raised and lowered using a pulley assembly 208 which includes a main drive wheel 210 around which is wrapped one end of a cord 212. The main drive wheel 210 is oriented generally vertically and aligned with the axis of rotation of the motor 186 such that the drive wheel 210 is coupled to the drive shaft of the motor 186 via a clutch mechanism 214. The cord 212 extends forwardly in a generally horizontal orientation from the main drive wheel 210, and is then looped vertically between a series of parallel pulley wheels 216, 218. The top set of pulley wheels 218 is mounted to the header 206, and the lower set of pulley wheels 216 is mounted to the carriage 188 between the upper and lower deck plates 190, 192 (with the upper deck plate 190 defining an aperture through which the cord 212 extends).

In operation, the ice-engaging mechanism 60 is lowered into contact with the ice block using gravity, the force exerted on the ice block depending on the weight of the drive head assembly 16, motor 186, and carriage 188, as well as the distance which the components are permitted to drop, and any contrary forces such as friction. The weight of these components are also utilized to provide downward pressure to lower the drive head assembly 16 during the ice shaving process, and deploy cord 212 from the main drive wheel 210. The downward movement of the drive head assembly 16, motor 186, and carriage 188 may also be controlled or retarded during the initial drop into contact with the ice block by a pair of air brakes 220 or pneumatic cylinders which each receive a piston 222 mounted on and extending downwardly from the carriage 188. The pistons 222 may be threaded in order to carry an adjustable block 224 designed to contact and engage a limit switch 226 to control the maximum raised height of the drive head assembly 16 (or to ensure that the drive head assembly 16 is located at a sufficiently raised position prior to permitting or initiating any descent of the drive head assembly 16 or rotation of the ice-engaging mechanism 60).

During operation of the motor 186 to impel the ice-engaging mechanism 60, the clutch mechanism 214 is disengaged to prevent rotation of the main drive wheel 210 and inadvertent uncoiling of the cord 212. While a frictionless static clutch has proven suitable, an electromagnetic clutch may be preferred in some applications to completely isolate the main drive wheel 210 from the motor 186 and corresponding drive linkage 56.

Reversing the motor 186 (and engaging the clutch mechanism 214) rotates the main drive wheel 210 and tensions the cord 212 (the free end of which is connected to the carriage 188), causing the pulley assembly 208 to operate and raise the drive head assembly 16, motor 186, and carriage 188. A combined weight of the drive head assembly 16, motor 186, and carriage 188 of approximately 20 lbs has proven adequate to provide sufficient force to engage and lower the components during the shaving process, and may be raised using an 8:1 ratio pulley assembly 208 in combination with a one-twelfth to one-quarter hp, high-torque DC electric motor 186. Alternately, other mechanisms which employ a different functional or structural operation and provide an equivalent mechanical advantage may be utilized to raise the drive head assembly 16, such as a four bar linkage lever -type mechanism.

It may be appreciated by those skilled in the relevant art that the motors and lift or drive linkages 43, 48, 56 comprise components or segments of an overall drive chain, and as used herein the term "drive chain" is intended to connote at least those portions of the overall drive chain extending between specified elements or components, including any operative couplings or connections, and any intervening structures or mechanism. The term "drive chain" is not intended to connote or imply the presence or use of any type of endless-loop belt, linked chain, or web, however such a structure may be utilized in a lift or drive linkage 43, 48, 56 that forms or is part of a drive chain. As such, an exemplary drive chain might include a motor, motor shaft, paired drive wheels, endless-loop chain, load shaft, and a load. There may be one or multiple drive linkages within a drive chain, and a complete drive chain may be formed by a single drive linkage or isolated within a larger multi-segment drive chain. Similarly, a drive chain may transmit either rotational or reciprocal linear motion to the load, and segments of the drive chain need not be exclusively rotary or linear, but may include combinations thereof, as well as translations therebetween or suitable equivalents therefor. For clarity and uniformity, the drive linkages 48, 56 which result in rotational movement of the drive head assembly 16 or ice-engaging mechanism 60 have been referred to herein as drive linkages 48, 56 and as components or segments of a drive chain, whereas lift linkage 43 which results in linear movement of the drive head assembly 16 or ice-engaging mechanism 60 has been referred to herein as lift linkages 43 and as components or segments of a lift chain, however both the drive linkages 48, 56 and lift linkage 43 may be considered exemplary of a drive chain.

While the preferred embodiments of the above rotary ice shaving machine 10 and its method of use and manufacture have been described in detail with reference to the attached drawing Figures, it is understood that various changes, modifications, and adaptations may be made in the ice shaving machine 10 without departing from the spirit and scope of the appended claims.

What is claimed is:

1. In an ice shaving machine used by an operator for shaving a block of ice, the ice shaving machine having a base, a drive head assembly, a table portion, and a blade, the blade being mounted relative to the table portion and moveable between a retracted position and an extended position, the blade having a sharp edge generally exposed relative to the table portion when the blade is in the extended position but generally protected relative to the table portion when the blade is in the retracted position, the block of ice being positioned in a region between the table portion and the drive head assembly when the block of ice is being shaved, the operator further having a hand with fingers, the improvement comprising:

a shield disposed generally between the table portion and the drive head assembly and moveable between an open position and a closed position, the shield at least partially obstructing the fingers of the hand of the operator from entering the region between the table portion and the drive head assembly and contacting the sharp edge of the blade when the shield is in the closed position and the blade is in the extended position; and an interlock mechanism operatively connected to the shield and to the blade, the interlock mechanism preventing the blade from being moved from the retracted position to the extended position unless the shield is in the closed position.

2. The improvement in an ice shaving machine of claim 1 further comprising:

a blade holder on which the blade is operatively mounted, the blade holder being connected to the table portion and moveable between the retracted position and the extended position of the blade; and an armature connected to the table portion and moveable between a first position and a second position, the armature contacting the blade holder and urging the blade holder to the extended position of the blade when the armature is in the second position, the armature permitting the blade holder to return to the retracted position of the blade when the armature is in the first position.

3. The improvement in an ice shaving machine of claim 2 wherein the interlock mechanism further comprises:

a latch member mounted on the table portion for pivoting movement relative thereto, the latch member being moveable between a safety position in which a portion of the latch member is in blocking engagement with the armature and prevents the armature from moving to the second position, and a release position in which the armature can move to the second position; and a projection mounted on the shield so as to operatively engage the latch member and move the latch member from the safety position to the release position when the shield is moved to the closed position.

4. The improvement in an ice shaving machine of claim 3 wherein the armature prevents the latch member from moving to the release position if the armature is in the second position.

5. The improvement in an ice shaving machine of claim 4 wherein the projection engages the latch member such that the shield cannot be moved from the closed position to the open position unless the latch mechanism is in the release position.

6. In an ice shaving machine used by an operator for shaving a block of ice, the ice shaving machine having a base, a drive head assembly, a table portion, and a blade, the blade being mounted relative to the table portion and having a retracted position and an extended position, the blade further having a sharp edge generally exposed to the operator when in the extended position but generally protected from inadvertent contact with the operator when in the retracted position, the block of ice being positioned in a region between the table portion and the drive head assembly when the block of ice is being shaved, the operator having a hand with fingers, the improvement comprising:

a shield disposed generally between the table portion and the drive head assembly and moveable between an open position and a closed position, the shield at least partially obstructing the fingers of the hand of the operator from entering the region between the table portion and the drive head assembly and contacting the sharp edge of the blade when the shield is in the closed position and the blade is in the extended position; and an interlock mechanism operatively connected to the shield, the interlock mechanism preventing the sharp edge of the blade from being generally exposed in the extended position unless the shield is in the closed position.

7. In an ice shaving machine used by an operator for shaving a block of ice, the ice shaving machine having a base, a drive head assembly, a table portion, and a blade, the table portion including an ice contacting surface, the blade being mounted relative to the table portion and having a retracted position and an extended position, the blade further having a sharp edge and a predetermined height relative to the ice supporting surface of the table portion when in the extended position, the improvement comprising:

wherein the block of ice has a surface being shaved, and further wherein the blade has a top planar face, a bottom planar face, and an angled face extending between the top planar face and the bottom planar face, the top planar face and the angled face defining a sharp edge of the blade which shaves the block of ice, the angled face being oriented generally away from the surface of the block of ice being shaved.

8. In an ice shaving machine used by an operator for shaving a block of ice, the ice shaving machine having a drive head assembly including an ice-engaging mechanism which revolves the block of ice about an axis of rotation, a table portion, a blade, and a blade holder operatively connected to the table portion, the blade having a length oriented generally radial relative to the axis of rotation of the block of ice, the blade further having an inner end and an outer end, the improvement comprising:

the blade being mounted on the blade holder such that the inner end of the blade is disposed a predetermined distance radially outward from the axis of rotation of the block of ice.

9. The improvement in an ice shaving machine of claim 8 wherein the predetermined distance is on the order of one-quarter inch or more.

10. In an ice shaving machine used by an operator for shaving a block of ice, the ice shaving machine having a base, a drive head assembly, a table portion, and a blade, the table portion including an ice contacting surface, the blade being mounted relative to the table portion and having a retracted position and an extended position, the blade further having a sharp edge and a predetermined height relative to the ice supporting surface of the table portion when in the extended position, the improvement comprising:

a blade holder on which the blade is operatively mounted, the blade holder being connected to the table portion and moveable between the retracted position and the extended position of the blade, the blade holder being normally biased toward theretracted position of the blade; and an armature connected to the table portion and moveable between a first position and a second position, the armature contacting the blade holder and urging the blade holder and the blade to the extended position when the armature is in the second position, the armature permitting the blade holder and the blade to return to the retracted position when the armature is in the first position.

11. The improvement in an ice shaving machine of claim 10 further comprising:

an adjustment mechanism connected to the blade holder permitting the operator to selectively adjust the predetermined height of the sharp edge of the blade relative to the ice contacting surface of the table portion during operation, the adjustment mechanism being generally independent of, and the predetermined height selected by the operator being substantially unaffected by, the subsequent movement of the blade holder between the retracted position and the extended position of the blade.

12. The improvement in an ice shaving machine of claim 10 wherein the table portion defines an aperture, the improvement further comprising:

a tang member operatively connected to the table portion and moveable between a lowered position and a raised position, the tang member including at least one prong member disposed so as to project upwardly from the aperture in the table portion when the tang member is moved to the raised position so as to engage the block of ice and prevent its lateral movement relative to the table portion, the tang member being moved to the raised position in response to the armature being moved to the first position.

13. The improvement in an ice shaving machine of claim 12 wherein the table portion has an underside, and wherein the tang member and the armature are pivotally mounted on the underside of the table portion.

14. The improvement in an ice shaving machine of claim 10 wherein the blade holder pivots about a pivotal axis oriented generally parallel with the table portion, and further wherein the armature rotates about an axis of rotation generally perpendicular to the pivotal axis of the blade holder.

15. The improvement in an ice shaving machine of claim 14 wherein the table portion has an underside, and wherein the blade holder and the armature are pivotally mounted on the underside of the table portion.

16. The improvement in an ice shaving machine of claim 14 wherein the blade holder has surface contacting a mating surface on the armature when the armature is moved from the first position to the second position, the surface on the blade holder and the mating surface on the armature being angled relative to one another such that movement of the armature to the second position exerts a force on the blade holder to pivot the blade holder to the extended position of the blade.

17. In an ice shaving machine used by an operator for shaving a block of ice, the ice shaving machine having a base, a drive head assembly including an ice-engaging mechanism, a table portion, and a blade, the improvement comprising:

a plurality of pins mounted on and independently moveable relative to the ice-engaging mechanism, each of the plurality of pins being biased toward the table portion and the block of ice.

18. An ice shaving machine for use by an operator in shaving a block of ice with a blade, the ice shaving machine comprising:

a base;

a table portion connected to the base for supporting the block of ice thereon;

a drive head assembly mounted on the base so as to move reciprocally up and down relative to the table portion, the drive head assembly moving between a raised position and a lowered position as the block of ice is shaved, the drive head assembly including an ice-engaging mechanism mounted for rotation about an axis generally perpendicular to the table portion, the ice-engaging mechanism being disposed at least partially above the table portion and moveable between the raised position and the lowered position with the drive head assembly;

a motor, the motor being operatively connected to the ice-engaging mechanism to rotate the ice-engaging mechanism and the block of ice;

a drive chain operatively connecting the motor to the ice-engaging mechanism; and a housing at least partially enclosing the drive head assembly and the drive chain, the drive head assembly and the ice-engaging mechanism descending toward the table portion from the raised position to the lowered position as the block of ice is shaved, and such that the portions of the drive head assembly, the ice block retaining mechanism, the drive chain, and the housing which are disposed above the table portion descend toward the table portion as the block of ice is shaved.

19. The ice shaving machine of claim 18 wherein the portions of the drive head assembly, the ice block retaining mechanism, the drive chain, and the housing which are disposed above the table portion descend toward the table portion at substantially the same linear rate as one another when the block of ice is shaved.

20. The ice shaving machine of claim 18 wherein the portions of the drive head assembly, the ice block retaining mechanism, the drive chain, and the housing which are disposed above the table portion descend substantially in unison with one another as the block of ice is shaved, such that no portion of the ice block retaining mechanism or the drive chain protrudes further upwardly or downwardly relative to the drive head assembly or the housing as the drive head assembly descends from the raised position toward the table portion.

21. The ice shaving machine of claim 18 wherein the housing which at least partially encloses the drive head assembly and the drive chain has a top surface, and wherein no moving portion of the ice block retaining mechanism or the drive chain extends above the top surface.

22. The ice shaving machine of claim 18 wherein the motor is disposed within the base, and further wherein the drive head assembly is supported and carried on a plurality of telescoping columns.

23. The ice shaving machine of claim 22 wherein the drive chain includes a drive shaft disposed within a one of the plurality of telescoping columns.

24. The ice shaving machine of claim 22 wherein the drive shaft includes a plurality of segments which telescope relative to one another.

25. The ice shaving machine of claim 24 wherein the drive chain further include a first drive linkage operatively connected between the motor and the drive shaft, and a second drive linkage operatively connected between the drive shaft and the ice-engaging mechanism, at least the second drive linkage descending with the drive head assembly and the ice-engaging mechanism as the block of ice is being shaved.

26. The ice shaving machine of claim 18 further comprising:

a frame operatively connected to the base and to the table portion; and a carriage mounted for reciprocal movement in a generally vertical direction between the raised position and the lowered position, the motor being mounted on the carriage, the motor and the carriage moving generally vertically along with the drive head assembly and the ice-engaging mechanism.

27. The ice shaving machine of claim 26 wherein a downward force is exerted on the block of ice when it is being shaved due to the weight of the motor, the carriage, and the drive head assembly.

28. The ice shaving machine of claim 26 wherein the ice-engaging mechanism is disposed a predetermined distance above the block of ice, and such that the motor, the carriage, and the drive head assembly are operatively configured to drop the predetermined distance causing the ice-engaging mechanism to contact and engage the block of ice prior to initiating rotation of the block of ice.

29. The ice shaving machine of claim 26 wherein the descent of the motor, the carriage, and the drive head assembly is retarded by a braking mechanism.

30. The ice shaving machine of claim 29 wherein the braking mechanism includes at least one pneumatic brake.

31. The ice shaving machine of claim 26 wherein the ice-engaging mechanism is disposed a predetermined distance above the block of ice, and such that at least the ice-engaging mechanism is operatively configured to drop the predetermined distance subject only to the force of gravity in the downward direction, causing the ice-engaging mechanism to contact and engage the block of ice prior to initiating rotation of the block of ice.

32. The ice shaving machine of claim 18 further comprising:

a lift chain operatively connecting the motor to the drive head assembly for moving the drive head assembly between the lowered position and the raised position.

33. The ice shaving machine of claim 32 wherein the lift chain further exerts force on the drive head assembly so as to urge the drive head assembly downward to apply pressure on the block of ice during shaving.

34. The ice shaving machine of claim 18 further comprising:

a second motor; and a lift chain operatively connecting the second motor to the drive head assembly for moving the drive head assembly between the lowered position and the raised position.

35. The ice shaving machine of claim 34 wherein the lift chain further exerts force on the drive head assembly so as to urge the drive head assembly downward to apply pressure on the block of ice during shaving.

36. An ice shaving machine for use by an operator in shaving a block of ice with a blade, the ice shaving machine comprising:

a base;

a table portion connected to the base for supporting the block of ice thereon;

a drive head assembly mounted on the base so as to move reciprocally up and down relative to the table portion, the drive head assembly moving between a raised position and a lowered position as the block of ice is shaved, the drive head assembly including an ice-engaging mechanism mounted for rotation about an axis generally perpendicular to the table portion, the ice-engaging mechanism being disposed at least partially above the table portion and moveable between the raised position and the lowered position with the drive head assembly;

a first motor to rotate the ice-engaging mechanism and the block of ice;

a drive chain operatively connecting the motor to the ice-engaging mechanism, the drive head assembly and the ice-engaging mechanism descending toward the table portion from the raised position to the lowered position as the block of ice is shaved, and such that the portions of the drive head assembly, the ice block retaining mechanism, and the drive chain which are disposed above the table portion descend toward the table portion as the block of ice is shaved;

a second motor for moving the drive head assembly between the lowered position and the raised position; and a lift chain operatively connecting the second motor to the drive head assembly.

37. The ice shaving machine of claim 36 wherein the second motor and the lift chain further exert force on the drive head assembly so as to urge the drive head assembly downward to apply pressure on the block of ice during shaving.

38. A method for shaving a block of ice, the method being performed at least in part by an operator, the operator having a hand with fingers, the method comprising the steps of:

providing an ice shaving machine, the ice shaving machine having a base, a motor, a drive head assembly including an ice-engaging mechanism, a table portion, a shield, a blade, and an interlock mechanism, the motor being operatively connected to the ice-engaging mechanism so as to rotate the ice-engaging mechanism and the block of ice, the blade being mounted relative to the table portion and moveable between a retracted position and an extended position, the shield disposed generally adjacent a region between the table portion and the drive head assembly and moveable between an open position and a closed position, the shield at least partially obstructing the fingers of the hand of the operator from entering the region between the table portion and the drive head assembly when the shield is in the closed position, the interlock mechanism operatively connected to the shield and to the blade, the interlock mechanism preventing the blade from being moved from the retracted position to the extended position unless the shield is in the closed position;

positioning the block of ice in a predetermined position on the table portion within the region between the table portion and the drive head assembly;

moving the shield to the closed position;

lowering the drive head assembly such that the ice-engaging mechanism contacts and engages the block of ice;

actuating the motor so as to rotate the ice-engaging mechanism and the block of ice at a predetermined rotational speed; and moving the blade from the retracted position to the extended position such that the blade contacts the block of ice and produces shavings therefrom.

39. The method of claim 38 wherein the step of moving the blade from the retracted position to the extended position includes the step of:

activating the interlock mechanism to prevent the shield from being moved to the open position.

40. The method of claim 38 wherein the ice shaving machine further includes an electrical interlock operatively connected to the shield and to the motor, and wherein the step of moving the shield to the closed position includes the step of:

activating the electrical interlock mechanism so as to permit actuating the motor to rotate the ice-engaging mechanism and the block of ice.

41. The method of claim 38 wherein the ice shaving machine further includes a lift chain operatively connected to the drive head assembly for lowering the drive head assembly, and an electrical interlock operatively connected to the shield and to the lift chain, and wherein the step of moving the shield to the closed position includes the step of:

activating the electrical interlock mechanism so as to permit actuating the lift chain to move the drive head assembly between the raised position and the lowered position.

* * * * *